US006630880B2

(12) United States Patent
Cheung et al.

(10) Patent No.: US 6,630,880 B2
(45) Date of Patent: Oct. 7, 2003

(54) WINDING STRUCTURE OF TRANSFORMER

(75) Inventors: Leung Tim Cheung, Shatin (HK); Meng Yu-Min, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/091,071

(22) Filed: Mar. 5, 2002

(65) Prior Publication Data

US 2003/0098769 A1 May 29, 2003

(30) Foreign Application Priority Data

Nov. 28, 2001 (TW) ..... 90129459 A

(51) Int. Cl.[7] ..... H01F 27/30
(52) U.S. Cl. ..... 336/198; 336/208
(58) Field of Search ..... 336/65, 83, 192, 336/198, 200, 206–208

(56) References Cited

U.S. PATENT DOCUMENTS 5,010,314 A * 4/1991 Estrov ..... 336/198
6,278,353 B1 * 8/2001 Downing et al. ..... 336/200
6,344,786 B1 * 2/2002 Chin ..... 336/198

* cited by examiner

*Primary Examiner*—Tuyen T. Nguyen
(74) *Attorney, Agent, or Firm*—Alston & Bird LLP

(57) ABSTRACT

A winding structure of a transformer is provided. The winding structure of a transformer includes: a first winding tube assembly which further includes a first lateral plate, a second lateral plate with a first connection apparatus, and a first winding tube positioned between the first lateral plate and the second lateral plate; a second winding tube assembly which further includes a first end plate, a second end plate with a second connection apparatus, and a second winding tube positioned between the first end plate and the second end plate. The first connection apparatus and the second connection apparatus are matched together to form and define a third winding tube.

23 Claims, 6 Drawing Sheets

WINDING STRUCTURE OF TRANSFORMER

FIELD OF THE INVENTION

The present invention is related to a winding structure of a transformer, and more particularly, to a winding structure of a transformer which can be easily assembled.

BACKGROUND OF THE INVENTION

As shown in FIG. 1, a conventional winding structure of a transformer which can be assembled includes two primary bobbin pieces 11, one secondary bobbin piece 12, and two shields 13. The primary bobbin piece 11 further includes one first winding tube 110 and two end plates 111 and 112 beside the first winding tube 110; wherein, the first winding tube 110 is provided for winding a primary winding (not shown). The secondary bobbin piece 12 further includes one secondary winding tube 120 and two end plates 122, 122 beside the secondary winding tube 120; wherein, the secondary winding tube 120 is provided for winding a secondary winding (not shown). The end plates 112, 122 separately connect to both sides of the shield 13. A base 1110 is located at the lower end of the end plate 111 for welding with a primary pin lead (not shown) and a secondary pin lead (not shown) so that the end of the primary winding and the end of the secondary winding can be welded thereon. Finally, a core is covered on the assembly of the primary bobbin piece 11 and the secondary bobbin piece 12 so as to accomplish the construction of the conventional transformer which can then be assembled. Although, the structure mentioned above can meet the electronic safety reqiurement of "creepage and clearance distance" of the transformer in most of countries; however, the assembly of the winding structure of a transformer requires five independent elements (two primary bobbin pieces 11, one secondary bobbin piece 12, and two shields 13); therefore, it has the disadvantages of high cost and being not easy for assembly.

SUMMARY OF THE INVENTION

It is therefor a object of the present invention to provide a winding structure of a transformer which requires only two assembly elements and then is less costly in respect of manufacturing and material controlling.

It is another object of the present invention to provide a winding structure of a transformer have multiple functions, i.e., winding; core positioning; engaging; and circuit board positioning.

According a preferred embodiment of the present invention, the winding structure of a transformer includes: a first winding tube assembly which further includes a first lateral plate, a second lateral plate with a first connection apparatus, and a first winding tube positioned between the first lateral plate and the second lateral plate; a second winding tube assembly which further includes a first end plate, a second end plate with a second connection apparatus, and a second winding tube positioned between the first end plate and the second end plate; wherein the first connection apparatus and the second connection apparatus are matched together to form and define a third winding tube.

Preferably, the first winding tube assembly and the second winding tube assembly are made of an insulation material.

Preferably, the first winding tube and the second winding tube are respectively wound with two primary windings.

Preferably, the third winding tube is wound with a secondary winding.

Preferably, the third winding tube is further wound with a primary winding.

Preferably, the first connection apparatus and the second connection apparatus are respectively a first protruding ring and a second protruding ring, said third winding tube is defined after said both rings are matched together.

Preferably, the second protruding ring includes an upper protruding ring and a lower protruding ring, the inner diameter of the first protruding ring substantially equals to the outer diameter of the upper protruding ring, and the outer diameter of the first protruding ring substantially equals to the outer diameter of the lower protruding ring.

Preferably, the first connection apparatus and the second connection apparatus are respectively a sleeve and a cylinder.

Preferably, the first connection apparatus and the second connection apparatus are respectively two first protruding sheets and two second protruding sheets so as to enhance a positioning effect along a horizontal direction.

Preferably, the winding structure of a transformer further includes an core.

Preferably, the core is one of an EI-core and an EE-core.

Preferably, the first lateral plate has a first core positioning device.

Preferably, the first core positioning device is a first groove formed by the two first protruding plates.

Preferably, the first end plate has a second core positioning device.

Preferably, the second core positioning device is a second groove formed by the two second protruding plates.

Preferably, a first base and a second base are respectively installed at lower portions of the first lateral plate and the first end plate for placing thereon a plurality of connection contacts.

Preferably, the first lateral plate and the first end plate respectively have at least two feet extending downward.

According another preferred embodiment of the present invention, the winding structure of a transformer includes: a first winding tube assembly which further includes a first lateral plate, a second lateral plate with a first connection apparatus, and a first winding tube positioned between the first lateral plate and the second lateral plate, the first lateral plate further has a first core positioning device and a first base; a second winding tube assembly which further includes a first end plate, a second end plate with a second connection apparatus, and a second winding tube positioned between the first end plate and the second end plate, the first end plate further has a second core positioning device and a second base; whereby the first connection apparatus and the second connection apparatus match together to form and define a third winding tube, the first core positioning device and the second core positioning device respectively initially position a first core element and a second core element.

Preferably, the first winding tube assembly and the second winding tube assembly are made of an insulation material.

Preferably, the first winding tube and the second winding tube are respectively wound with two primary windings and the third winding tube is wound with a secondary winding.

Preferably, the first connection apparatus and the second connection apparatus are respectively a first protruding ring and a second protruding ring, said third winding tube is defined after said both rings are matched together.

Preferably, the second protruding ring includes an upper protruding ring and a lower protruding ring, the inner diameter of the first protruding ring substantially equals to the outer diameter of the upper protruding ring, and the outer diameter of the first protruding ring substantially equals to the outer diameter of the lower protruding ring.

Preferably, the first connection apparatus and the second connection apparatus are respectively a sleeve and a cylinder.

Preferably, the first connection apparatus and the second connection apparatus are respectively two first protruding sheets and two second protruding sheets so as to enhance a positioning effect along a horizontal direction.

Preferably, the first core positioning device is a first groove formed by the two first protruding sheets.

Preferably, the second core positioning device is a second groove formed by the two second protruding sheets.

Preferably, the first lateral plate and the first end plate respectively have at least two feet extending downward.

Now the foregoing and other features and advantages of the present invention will be more clearly understood through the following descriptions with reference to the drawings, wherein:

DETAILED DESCRIPTION OF THE PREFERRED EMBODIMENT

Figure 2:
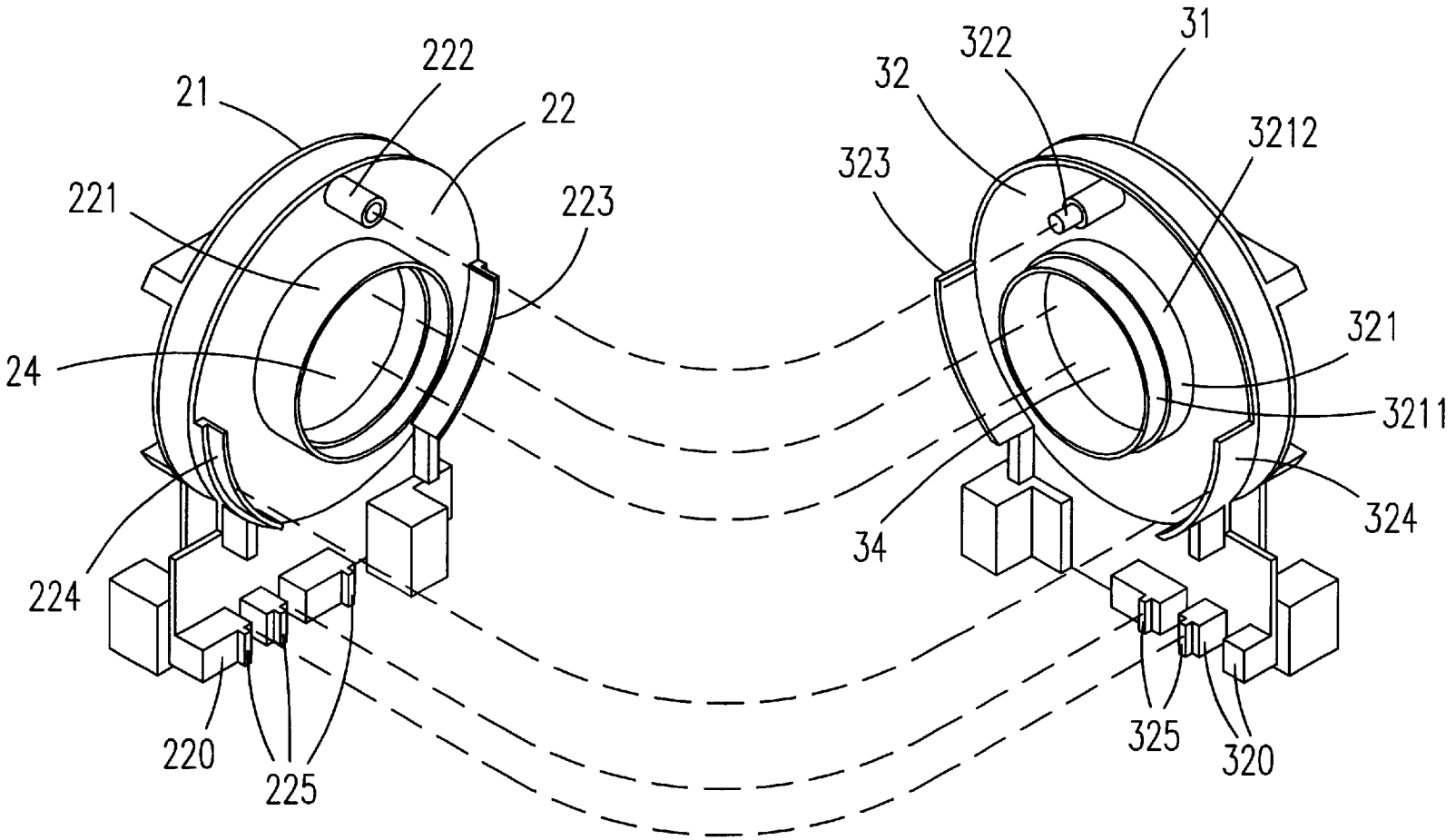
FIG. 2 shows a first winding tube assembly and a second winding tube assembly to be assembled according to the present invention.
Figure 3:
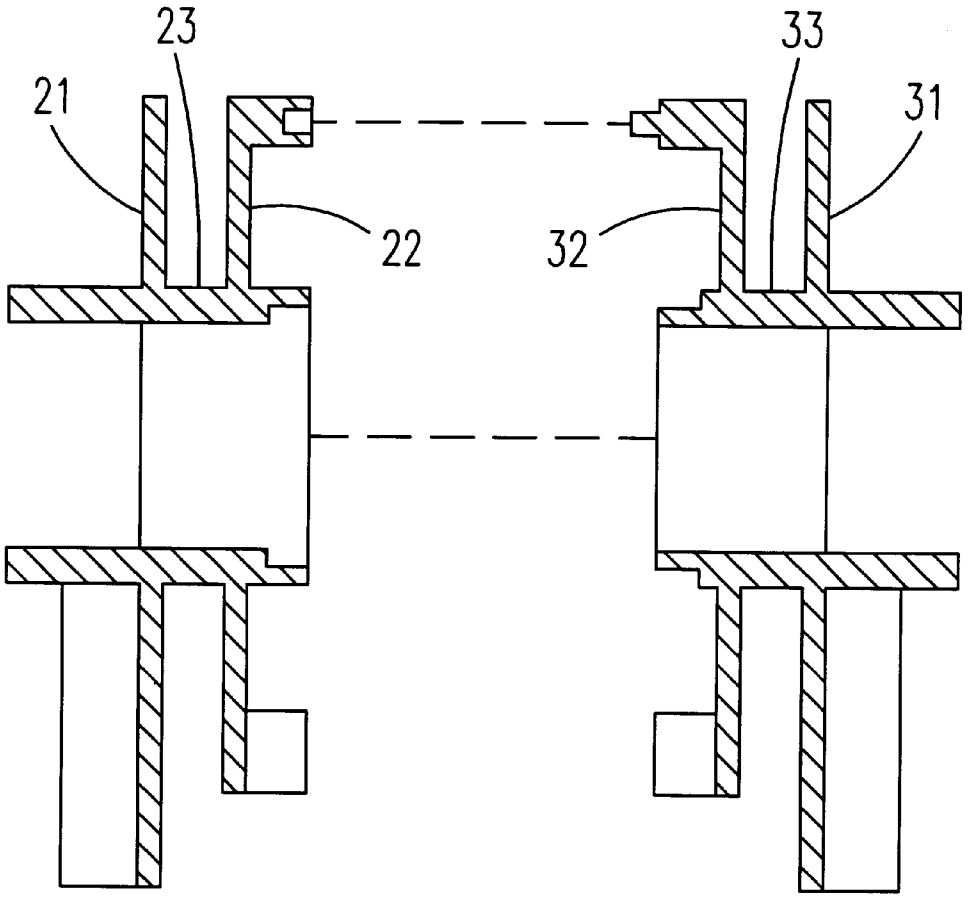
FIG. 3 is a cross sectional view of the first winding tube assembly and the second winding tube according to the present invention.

Please refer to FIG. 2 and FIG. 3. According to a preferred embodiment of the present invention, a winding structure of a transformer includes a first winding tube assembly 2 and a second winding tube assembly 3. The first winding tube assembly 2 includes a first lateral plate 21, a second lateral plate 22, and a first winding tube 23, wherein the first winding tube 23 is positioned between the first lateral plate 21 and the second lateral plate 22. The second lateral plate 22 further has a first connection apparatus 221–225. The second winding tube assembly 3 further includes a first end plate 31, a second end plate 32, and a second winding tube 33, wherein the second winding tube 33 is positioned between the first end plate 31 and the second end plate 32. The second end plate 32 further has a second connection apparatus 321–325. At the middle of the first winding tube assembly 2 and second winding tube assembly 3, there are respectively a first through hole 24 and a second through hole 34.

The first connection apparatus includes a first protruding ring 221 which protrudes outward from the first through hole 24; a sleeve 222 which projects from the upper portion of the second lateral plate 22; two first protruding sheets 223, 224 which protrude from the edge of the second lateral plate 22; and a plurality of first protruding bars 225 which protrude from the lower portion of the second lateral plate 22. The second connection apparatus includes a second protruding ring 321 which is a two-step protruding ring, protrudes outward from the second through hole 34, and further comprises an upper protruding ring 3211 and a lower protruding ring 3212; a cylinder 322 which projects from the upper portion of the second end plate 32; two second protruding sheets 323, 324 which protrude from the edge of the second end plate 32; and a plurality of second protruding bars 325 which protrude from the lower portion of the second end plate 32. The inner diameter of the first protruding ring 221 substantially equals to the outer diameter of the upper protruding ring 3211 of the second protruding ring 321, and the outer diameter of the first protruding ring 221 substantially equals to the outer diameter of the lower protruding ring 3212 of the second protruding ring 321, such that, when the first protruding ring 221 and the second protruding ring match together, the first protruding ring 221 cooperating with the lower protruding ring 3212 of the second protruding ring 321 defines a third winding tube (not shown). The Sleeve 222 and cylinder 322 match together so as to enhance the positioning effect in the vertical direction. The two first protruding sheets 223, 224 and the two second protruding sheets 323, 324 match together so as to enhance the positioning effect in the horizontal direction. The first protruding bars 225 and the second protruding bars 325 are respectively embedded in gaps of a lower block 320 of the second end plate 32 and in gaps of a lower block 220 of the second lateral plate 22.

Figure 4:
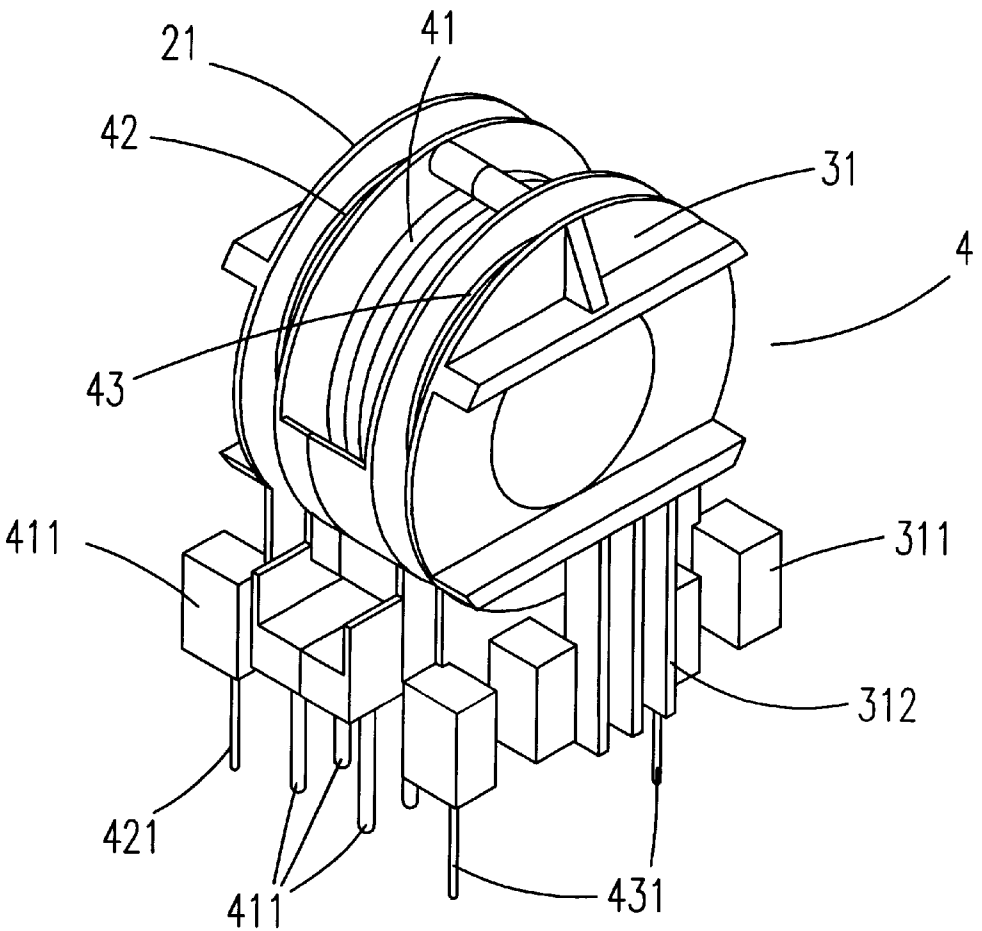
FIG. 4 is a perspective view of the assembly of a first winding tube assembly and a second winding tube assembly after wound with windings according to the present invention.

The present invention has the feature that the first protruding ring 221 and/or the lower protruding ring 3212 of the second protruding ring 321 can be wound with a number of turns in advance, for example, a secondary winding and/or a primary winding. Accordingly, when the first winding tube assembly 2 and the second winding tube assembly 3 match together, the third winding tube has been wound with winding 41 as shown in FIG. 4. Moreover, the first winding tube 23 and the second winding tube 33 can be wound with primary windings 42, 43 before or after the first winding tube assembly 2 and the second winding tube assembly 3 match together.

As shown in FIG. 4, a first base 211 and a second base 311 are respectively installed at the lower portions of the first lateral plate 21 and the first end plate 31 for placing thereon a plurality of connection contacts 411, 421, 431. The ends of windings 41, 42, 43 are respectively welded on connection contacts 411, 421, 431. Accordingly, when the winding structure of a transformer 4 is assembled with a circuit board, they are connected to each other. Moreover, the first lateral plate 21 and the first end plate 31 respectively have a first foot (not shown) and a second foot 312 extending downward for engaging with corresponding positioning holes (not shown) of the circuit board.

Figure 5:
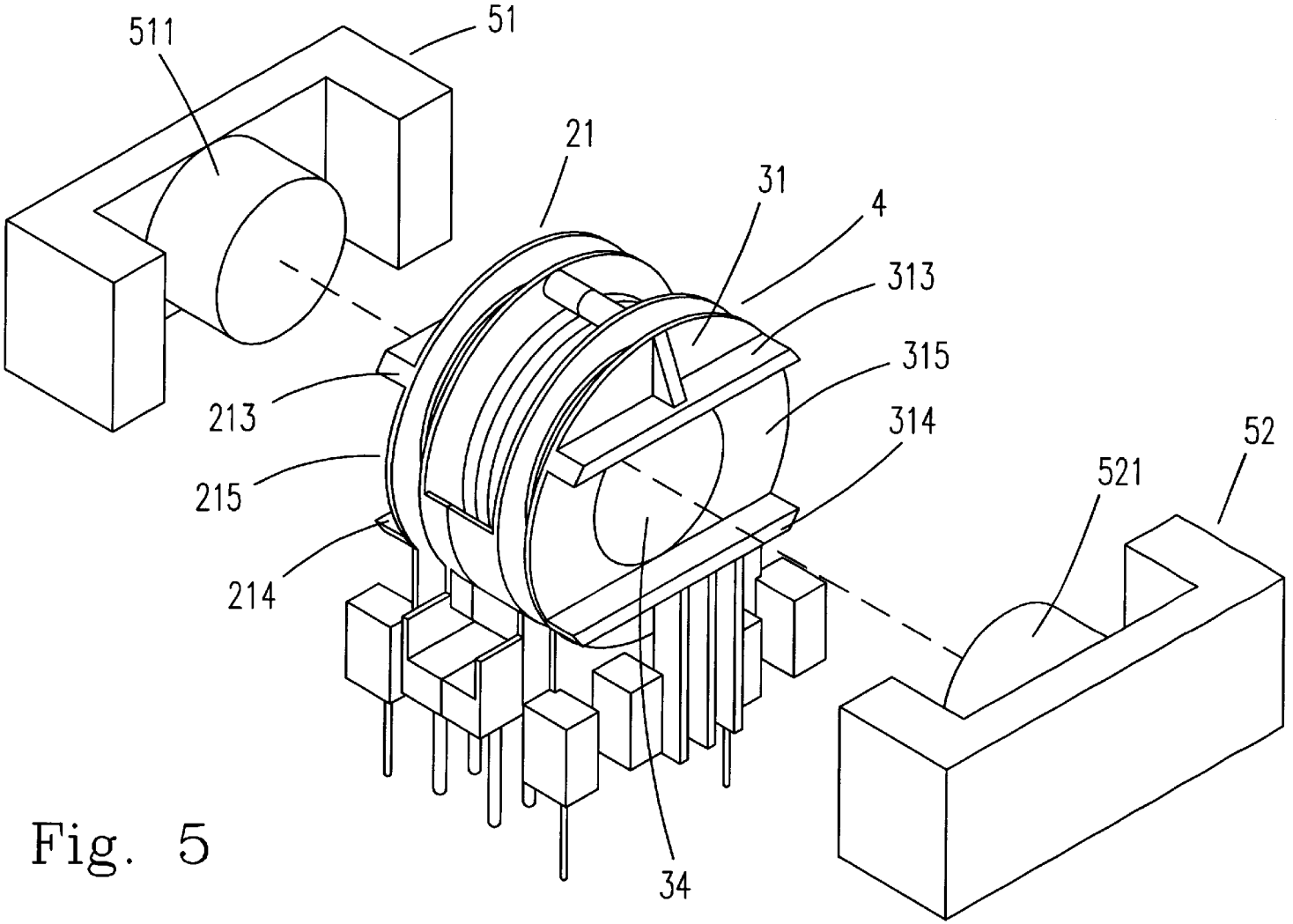
FIG. 5 shows the winding structure and the EE core to be assembled.
Figure 6:
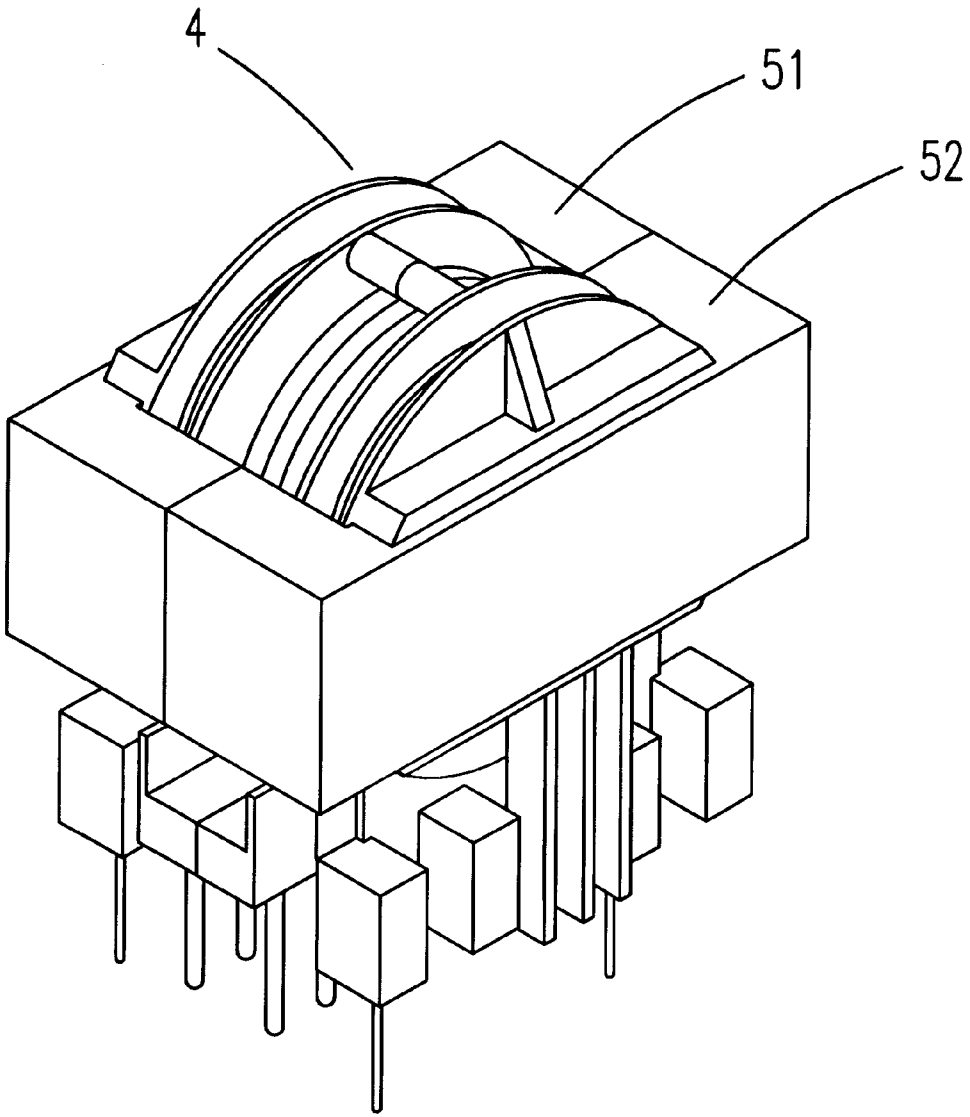
FIG. 6 is a perspective view of the assembly of the winding structure and the EE core.

FIG. 5 shows the winding structure of a transformer and the EE core to be assembled. Two first protruding plates 213, 214 are formed on the first lateral plate 21, and a first groove 215 is formed between the two first protruding plates 213, 214. Two second protruding plates 313, 314 are formed on the first end plate 31, and a second groove 315 is formed between the two second protruding plates 313, 314. Two core elements 51, 52 of the EEE-core respectively have protruding portions 511, and 512 formed at the central portions thereof. The two protruding portions 511, and 512 are respectively inserted into the first through hole 24 and the second through hole 34 so that the core elements 51, 52 are respectively placed into the first groove 215 and the second groove 315. Accordingly, the core elements 51, 52 are positioned in the vertical direction by means of the two first protruding plates 213, 214 and the two second protruding plates 313, 314. Alternatively, the core elements 51, 52 may be EI-cores. Finally, the core elements 51, 52 are glued together or bound with tape so as to accomplish the winding structure of a transformer of the present invention.

In the present invention, the first lateral plate 21; the second lateral plate 22; the first winding tube 23; the first base 211; the first connection apparatus 221–225; the first foot; and the first protruding plates 213, 214 of the first winding tube assembly 2 are formed by injection molding. The corresponding portions of the second winding tube assembly 3 are the same. Such an insulation effect can meet the electronic safety reqiurement of "creepage and clearance distance" of the transformer.

Figure 1:
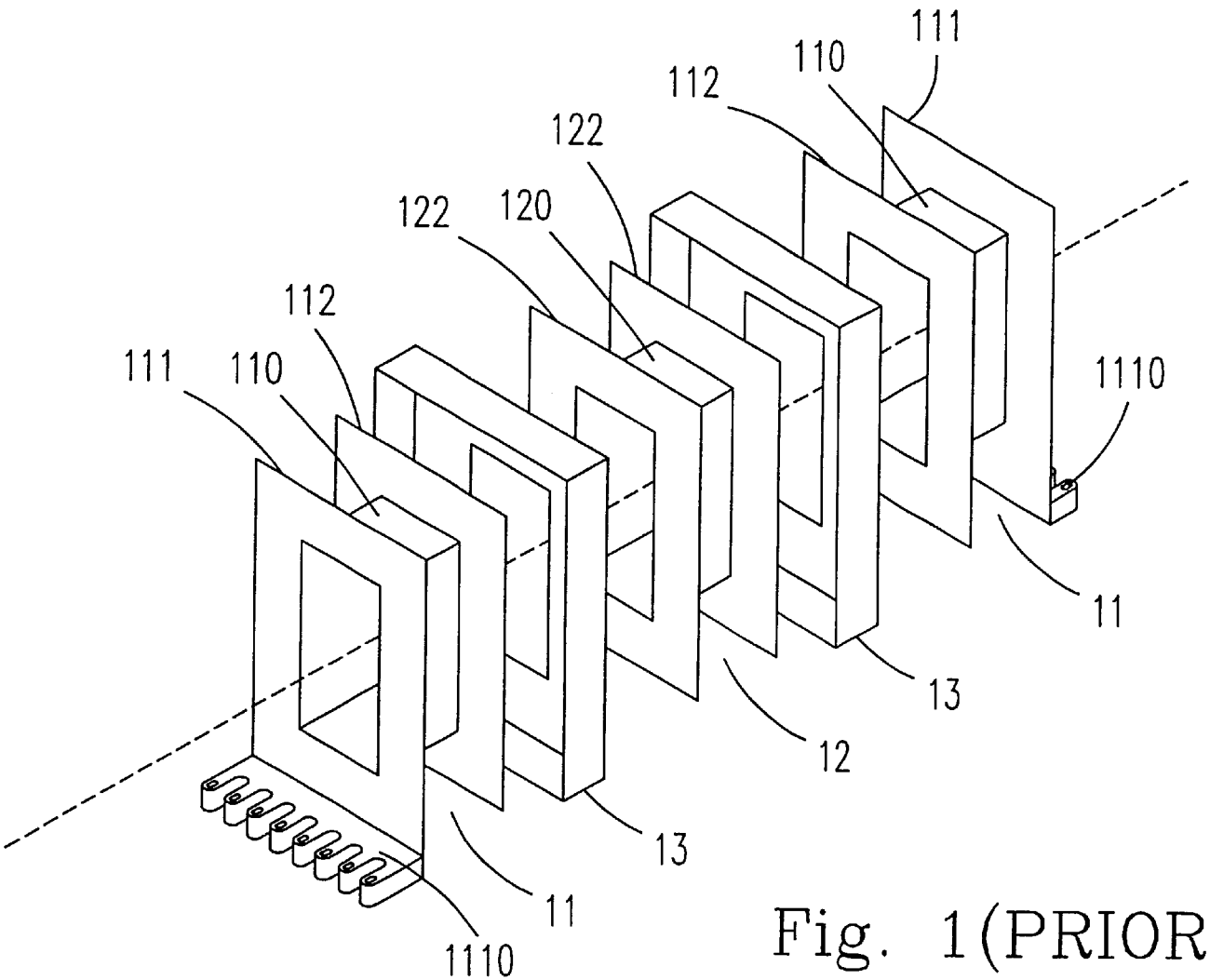
Fig. 1(PRIOR ART)
FIG. 1 is a winding structure of a transformer which can be assembled according to the prior art.

In contrast to the prior art as shown in FIG. 1, the present invention has the following advantages:

1. The winding structure of a transformer of the present invention requires only two assembly elements, i.e., a first winding tube assembly 2 and a second winding tube assembly 3. On the contrary, the winding structure of a transformer according to the prior art requires five assembly element, i.e., two primary bobbin pieces 11; one secondary bobbin piece 12 and two shields 13. Obviously, the winding structure of a transformer of the present invention is less costly in respect of manufacturing and material controlling.
2. According to the winding structure of a transformer of the present invention, the first winding tube assembly 2 and the second winding tube assembly 3 have multiple functions, i.e., winding (the first winding tube 23, the second winding tube 33, and the third winding tube); core positioning (the first protruding plates 213, 214 and the second protruding plates 313, 314); engaging (the first connection apparatus 221–225 and the second connection apparatus 321–325); and circuit board positioning (the first foot and the second foot).

In summary, the winding structure of a transformer of the present invention is less costly, can be well positioned and simply manufactured, and conforms to the safety reqiurement. Consequently, the present invention can rectify the drawbacks of the prior art and is practicable, novel, and progressive.

Although the present invention has been described and illustrated in detail, it is to be clearly understood that the same is by the way of illustration and example only and is not to be taken by way of limitation, the spirit and scope of the present invention being limited only by the terms of the appended claims.

What is claimed is:

1. A winding structure of a transformer comprising:

a first winding tube assembly further comprising:

a first lateral plate;

a second lateral plate wit a first connection apparatus having a first protruding ring; and a first winding tube positioned between said first lateral plate and said second lateral plate; and a second winding tube assembly further comprising:

a first end plate;

a second end plate with a second connection apparatus having a second protruding ring which comprises an upper protruding ring and a lower protruding ring; and a second winding tube positioned between said first end plate and said second end plate;

whereby said first protruding ring of said first connection apparatus and said second protruding ring of said second connection apparatus are matched together to form and define a third winding tube, and an inner diameter of said first protruding ring is substantially equal to an outer diameter of said upper protruding ring, and an outer diameter of said first protruding ring is substantially equal to an outer diameter of said lower protruding ring.

2. The winding structure of a transformer as claimed in claim 1, wherein said first winding tube assembly and said second winding tube assembly are made of an insulation material.

3. The winding structure of a transformer as claimed in claim 1, wherein said first winding tube and said second winding tube are respectively wound with two primary windings.

4. The winding structure of a transformer as claimed in claim 1, wherein said third winding tube is wound with a secondary winding.

5. The winding structure of a transformer as claimed in claim 4, wherein said third winding tube is further wound with a primary winding.

6. The winding structure of a transformer as claimed in claim 1, wherein said first connection apparatus and said second connection apparatus are respectively further comprise a sleeve and a cylinder.

7. The winding structure of a transformer as claimed in claim 1, wherein said first connection apparatus and said second connection apparatus are respectively further comprise two first protruding sheets and two second protruding sheets so as to enhance a positioning effect along a horizontal direction.

8. The winding structure of a transformer as claimed in claim 1, wherein said winding structure of a transformer further includes an core.

9. The winding structure of a transformer as claimed in claim 8, wherein said core is one of an EI-core and an EE-core.

10. The winding structure of a transformer as claimed in claim 8, wherein said first lateral plate has a first core positioning device.

11. The winding structure of a transformer as claimed in claim 10, wherein said first core positioning device is a first groove formed by two first protruding plates.

12. The winding structure of a transformer as claimed in claim 8, wherein said first end plate has a second core positioning device.

13. The winding structure of a transformer as claimed in claim 12, wherein said second core positioning device is a second groove formed by two second protruding plates.

14. The winding structure of a transformer as claimed in claim 1, wherein a first base and a second base are respectively installed at lower portions of said first lateral plate and said first end plate for placing thereon a plurality of connection contacts.

15. The winding structure of a transformer as claimed in claim 1, wherein said first lateral plate and said first end plate respectively have at least two feet extending downward.

16. A winding structure of a transformer comprising:

a first winding tube assembly further comprising:

a first lateral plate further comprising a first core positioning device and a first base;

a second lateral plate with a first connection apparatus having a first protruding ring; and a first winding tube positioned between said first lateral plate and said second lateral plate; and a second winding tube assembly further comprising:

a first end plate further comprising a second core positioning device and a second base;

a second end plate with a second connection apparatus having a second protruding ring which comprises an upper protruding ring and a lower protruding ring; and a second winding tube positioned between said first end plate and said second end plate;

whereby said first connection apparatus and said second connection apparatus match together to form and define a third winding tube; an inner diameter of said first protruding ring is substantially equal to an outer diameter of said upper protruding ring, and an outer diameter of said first protruding ring is substantially equal to an outer diameter of said lower protruding ring, and said first core positioning device and said second core positioning device respectively initially position a first core element and a second core element.

17. The winding structure of a transformer as claimed in claim 16, wherein said first winding tube assembly and said second winding tube assembly are made of an insulation material.

18. The winding structure of a transformer as claimed in claim 16, wherein said first winding tube and said second winding tube are respectively wound with two primary windings and said third winding tube is wound with a secondary winding.

19. The winding structure of a transformer as claimed in claim 16, wherein said first connection apparatus and said second connection apparatus are respectively further comprise a sleeve and a cylinder.

20. The winding structure of a transformer as claimed in claim 16, wherein said first connection apparatus and said second connection apparatus are respectively further comprise two first protruding sheets and two second protruding sheets so as to enhance a positioning effect along a horizontal direction.

21. The winding structure of a transformer as claimed in claim 16, wherein said first core positioning device is a first groove formed by two first protruding plates.

22. The winding structure of a transformer as claimed in claim 16, wherein said core positioning device is a second groove formed by two second protruding plates.

23. The winding structure of a transformer as claimed in claim 16, wherein said first lateral plate and said first end plate respectively have at least two feet extending downward.

* * * * *

UNITED STATES PATENT AND TRADEMARK OFFICE

CERTIFICATE OF CORRECTION

PATENT NO. : 6,630,880 B2
DATED : October 7, 2003
INVENTOR(S) : Leung et al.

It is certified that error appears in the above-identified patent and that said Letters Patent is hereby corrected as shown below:

Column 5,
Line 56, “wit” should read -- with --.

Column 6,
Lines 26 and 30, cancel “are”.

Column 8,
Lines 6 and 10, cancel “are”.

Signed and Sealed this

Ninth Day of December, 2003

JAMES E. ROGAN
*Director of the United States Patent and Trademark Office*